US006315037B1

(12) United States Patent
Haussmann

(10) Patent No.: US 6,315,037 B1
(45) Date of Patent: Nov. 13, 2001

(54) FLAT TUBE HEAT EXCHANGER WITH MORE THAN TWO FLOWS AND A DEFLECTING BOTTOM FOR MOTOR VEHICLES, AND PROCESS FOR MANUFACTURING THE SAME

(75) Inventor: Roland Haussmann, Wiesloch (DE)

(73) Assignee: Valeo Klimatechnik GmbH & Co., KG. (DE)

( * ) Notice: Subject to any disclaimer, the term of this patent is extended or adjusted under 35 U.S.C. 154(b) by 0 days.

(21) Appl. No.: 09/214,457

(22) PCT Filed: May 5, 1998

(86) PCT No.: PCT/EP98/02637

§ 371 Date: Jun. 5, 1999

§ 102(e) Date: Jun. 5, 1999

(87) PCT Pub. No.: WO98/50750

PCT Pub. Date: Nov. 12, 1998

(30) Foreign Application Priority Data

May 7, 1997 (DE) ..... 197 19 256

(51) Int. Cl.[7] ..... F28F 9/02; F28D 7/06; F28D 1/02

(52) U.S. Cl. ..... 165/174; 165/176; 165/153

(58) Field of Search ..... 165/176, 174, 165/153; 228/223, 224, 183, 208

(56) References Cited

U.S. PATENT DOCUMENTS

| | | | | |
|---|---|---|---|---|
| 5,009,262 | * | 4/1991 | Halstead et al. | 165/176 |
| 5,180,098 | * | 1/1993 | Halstead et al. | 228/223 |
| 5,251,694 | * | 10/1993 | Chigira | 165/153 |
| 5,314,013 | * | 5/1994 | Tanabe | 165/176 |
| 5,318,114 | * | 6/1994 | Sasaki | 165/176 |
| 5,479,985 | | 1/1996 | Yamamoto et al. . | |
| 5,605,191 | | 2/1997 | Eto et al. | 165/176 |

FOREIGN PATENT DOCUMENTS

| | | | | |
|---|---|---|---|---|
| 398 490 B | | 12/1994 | (AT) . | |
| 21 61 279 | | 4/1973 | (DE) . | |
| 22 43 617 | | 9/1973 | (DE) . | |
| 7414340.1 | | 1/1974 | (DE) . | |
| 31 32 078 | | 3/1982 | (DE) . | |
| 43 34 768 | | 5/1994 | (DE) . | |
| 44 46 817 | | 7/1995 | (DE) . | |
| 4446817A1 | * | 7/1995 | (DE) . | |
| 19603016 | | 7/1996 | (DE) . | |
| 16515528A1 | * | 10/1996 | (DE) . | |
| 195 15 528 | | 10/1996 | (DE) . | |
| 195 36 117 | | 4/1997 | (DE) . | |
| 0 662 591 | | 7/1995 | (EP) . | |
| 0 709 644 A2 | | 5/1996 | (EP) . | |
| 2 390 692 | | 12/1978 | (FR) . | |
| 2166862 | * | 5/1986 | (GB) | 165/176 |
| 405001896 | * | 1/1993 | (JP) | 165/176 |

* cited by examiner

*Primary Examiner*—Ira S. Lazarus
*Assistant Examiner*—Tho Duong
(74) *Attorney, Agent, or Firm*—Morgan & Finnegan, LLP

(57) ABSTRACT

The invention relates to a flat tube heat exchanger with two or more flows for motor vehicles with a deflecting (or reversing) bottom for deflecting (or reversing) adjacent flows of the flat tubes. According to the invention, it is provided that the deflecting bottom is resolved into deflecting bowls individually assigned to each flat tube, which bowls are connected to one another only via their connection to the respectively assigned flat tubes. The invention also relates to a process for manufacturing such a flat tube beat exchanger by pulling off, straightening and cutting into sections the flat tubes from a coil, mechanically pre-assembling the flat tube heat exchanger from its structural parts including the flat tubes and soldering or brazing. Here, it is provided that the deflecting bowls are mechanically pre-assembled with the flat tubes after they have been cut into sections and before pre-assembling the flat tube heat exchanger with the flat tubes.

15 Claims, 5 Drawing Sheets

FLAT TUBE HEAT EXCHANGER WITH MORE THAN TWO FLOWS AND A DEFLECTING BOTTOM FOR MOTOR VEHICLES, AND PROCESS FOR MANUFACTURING THE SAME

BACKGROUND OF THE INVENTION

The invention relates to a flat tube heat exchanger with more than two flows, preferably an evaporator, for motor vehicles having a deflecting (or reversing) bottom for deflecting (or reversing) adjacent flows of the flat tubes with the features of the preamble of claim 1. Such a flat tube heat exchanger with a deflecting bottom is known from the DE 195 15 528A1. In such flat tube heat exchangers, in the past either deflecting bottoms being an integral part from the beginning or, according to the prior art from which the invention departs, individual deflecting bottoms linked to one another and forming a structural unit as a whole have been used. In the past, this structure has been provided for stability reasons, and at the other ends of the flat tubes normally a cohesion is furthermore effected via the header common to the flat tubes, such that this header and the coherent deflecting bottom together form a frame-like mounting for the whole structure of the flat tube heat exchanger. This is in particular true for the pre-assembly before soldering or brazing, e.g. for preventing the zig zag fins from slipping out before being soldered or brazed.

The term header is generally not to only mean an intermediate header or a header on the outlet side, but also a distributor on the inlet side.

BRIEF SUMMARY OF THE INVENTION

The object underlying the invention is to further simplify the design and the manufacturing process of a flat tube heat exchanger of the mentioned type having more than two flows.

This object is solved in a flat tube heat exchanger having more than two flows with the features of the preamble of claim 1 by the characterizing features thereof.

Equally to the double-flow flat tube heat exchanger according to the DE-A1-195 36 117, in particular FIG. 5, the invention is a renunciation of the idea to effect the respective deflection in an integrally coherent deflecting bottom. Instead, deep-drawn equal deflecting bowls which can be premanufactured are also used as in this known double-flow flat tube heat exchanger.

In the flat tube heat exchangers having more than two flows, to which the invention is related, within the deflecting bowl a separation has to be effected for those adjacent flows which are not deflected to one another directly within the respective deflecting bowl. Within the scope of the invention—and in the preferred further development according to claim 6—in a novel manner, a necessary separating web is integrally finished in the deflecting bowl as a local wall design of the deflecting bowl, which can additionally be effected during deep-drawing the deflecting bowl and which renders dispensable the requirement to separately and tightly insert such a separating web or several thereof.

The individual deflecting bowls can be especially easily included in the pre-assembly when manufacturing the flat tube heat exchanger, in particular according to the manufacturing process of claim 10, and they can be finished with a greater depth as deflecting compartments of integral deflecting bottoms with at least one separating web already shaped therein at equal partition distances. Moreover, their use is especially favourable if the relative distances between the flat tubes become gradually smaller looked from the point of view of a design of the flat tube heat exchanger which is as compact as possible. In general, the invention preferably relates to flat tube heat exchangers made of aluminum or an aluminum alloy. Correspondingly, the deflecting bowls are also made of aluminum or an aluminum alloy. In this case, the flat tube heat exchanger itself should consist of a material which is also during soldering compatible with the material of the deflecting bowls, if possible.

A first alternative, preferred due to the easiness of the manufacture, is the local wall design tightly cooperates only with a parting wall of the adjacent ducts of the respective flat tube, wherein in a preferred manner the complete function of the respective flat tube is maintained. However, an equally useful second alternative is possible, i.e. to have the parting wall between adjacent ducts of related to flows, communicating not directly in the bottom, is formed by a duct of the flat tube which is cut out, i.e. not used or ineffective as a guiding duct for a flow. Apart from the concrete further developments of reinforcing the wall thickness of the cut out (or ineffective) duct by an inset insertion member that may be sealingly contacted by the separating web, the use of a cut out duct can be carried out especially easily and advantageously by pressing the separating web in the deflecting bowl into the duct to be cut out with respect to flows, blocking it at the same time and thus obtaining a seal at the end of this duct due to material displacement.

The further development of the invention where the deflecting bowl is designed at the inner faces of its two narrow sides with a stop base each for the free ends of the front sides of the respective flat tube favors the assembly as well as the stability of the flat tube. In this development, the separating web furthermore has a supplementing central stop function. In applications of fluxing agents from the outside, the deflecting bowl is designed at the inner face of its two longitudinal sides, locally in the region of the separating web, with a supply flute of a fluxing agent for a braze. This favors a secure soldering or brazing of the deflecting bowl with the flat tube in the especially critical region of the separating web.

With deep-drawn parts, such as the deflecting bowls designed with at least one partition, there is always the problem of evenly designing the edge, as in general, an uneven design results from the deep-drawing process. This requires a trimming of this edge. The most simple way to realize this trimming is that the surrounding free edge of the deflecting bowl is bent to the outside forming an opening in the carrying out the trimming process in the same direction as the deep-drawing process. Apart from this, in this inconventional technique of the opening up in the form of a tulip, furthermore accidentally a convenient introducing inclination for the flat tube, not contained in the deflecting bowls according to FIG. 5 of the DE-A1-195 36 117, or a corresponding introduction radius as an assembly aid is obtained.

BRIEF DESCRIPTION OF THE DRAWINGS

The invention will be further illustrated by means of schematic drawings and several embodiments as follows, wherein:

FIG. 6 shows a partial section in the region of the narrow front side of the flat tube longitudinal of the deflecting bowl.

DETAILED DESCRIPTION OF DRAWINGS

Figure 1:
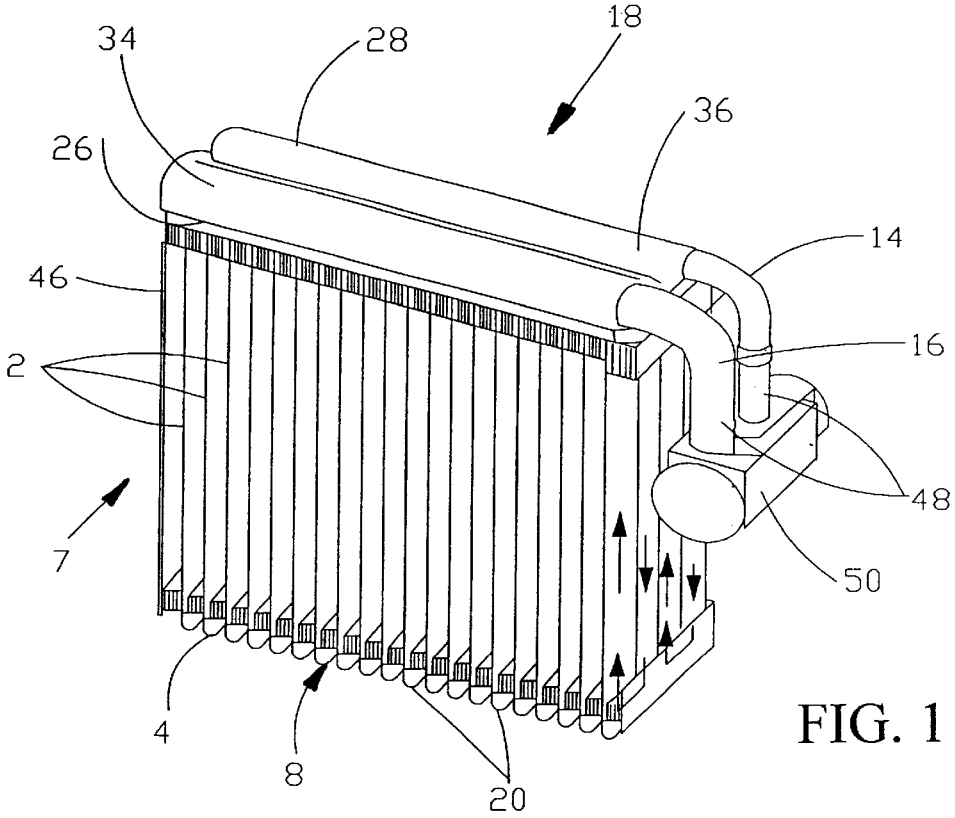
FIG. 1 shows a perspective view of a four-flow flat tube heat exchanger, the flows of which are indicated by arrows.

The flat tube heat exchanger represented in the figures has a four-flow design and is designed as an evaporator of a refrigerant circulation.

This does not exclude the adaption of the represented features to flat tube heat exchangers having more than two flows with a different number of flows, optionally also to those flat tube heat exchangers not serving as an evaporator.

The flat tube heat exchanger has the following general design:

A major number of, typically twenty to thirty, flat tubes 2 is arranged at constant distances to each other and with aligned front sides 4. Between the flat sides 6 of the flat tubes each, a zig zag fin 8 is interested in a sandwiched fashion. A zig zag fin 8 each is furthermore arranged at the two outer surfaces of the outer flat tubes. Each flat tube comprises internal reinforcing webs 10, which divide off chambers 12 into ducts. Depending on the structural depth, a number of the chambers or ducts 12 of ten to thirty is typical.

The mentioned typical regions of the number of flat tubes and the chambers thereof are here only intended to be preferred and not to be restricting.

In a motor vehicle air conditioning equipment, in the final state outer air as an external heat exchange medium flows in the direction of the structural depth through the block arrangement of the flat tubes 2 and the zig zag fins 8.

In the evaporator, a refrigerant, such as in particular fluorohydrocarbon, serves as internal heat exchange medium which enters the flat tube heat exchanger via a supply line 14 and exits the heat exchanger via an outlet line 16. In the refrigerant circulation, the supply line comes from the liquefier thereof. The outlet line 16 leads to the condensor of the refrigerant circulation.

In an evaporator, the distribution of the refrigerant on the inlet side is effected from the supply line 14 to the individual flat tubes by a so-called distributor. On the outlet side, the refrigerant is supplied as a whole to the outlet line 16. Though it is possible to assign the distribution and the collection to separate boxes, in all embodiments both functions are combined in a common header 18.

This header 18 is then arranged at a front side 4 of the flat tubes 2, while at the other front side 4 of the flat tubes 2, a flow reverse takes place only between each of the flows, here for example by the deflecting (or reversing) bowls 20 individually assigned to each flat tube 2, which can possibly be integrated by links (not shown) to form a modular unit, if necessary.

In the borderline case of a one-flow heat exchanger, the deflecting bowls 20 would be able to take over the function of the connections of an outlet header, if a common outlet line is connected thereto.

The number of more than two flows means at least a double flow reverse in the region of the individual ducts formed by the chambers 12 in each flat tube 2. Different from the double-flow design, in which the deflecting bowl 20 would not need any further intermediate chamber subdivision as in its function as a connection of an outlet header, but only the one-time deflecting function would have to be guaranteed, in case of a deflection of more than two flows, at least the parting wall 24 represented in case of a four-flow is necessary, so that in this case of the four-flow design, a double simple deflection in the respective deflecting bowl 20 is effected. In a design with an even greater number of flows, the number of parting walls 24 optionally is increased.

In the represented embodiments, the header 18 is—without restricting the generality—basically composed of a tube bottom 26 and a cap 28, wherein optionally further parts for assembling the header 18 can be provided which are at least partially mentioned in the following.

The free ends of the flat tubes 2 opposite the deflecting bowls 20 tightly engage the tube bottom 26 in communication with the inner space of the header 18, which tube bottom is correspondingly provided with engaging slits as well as optionally with internal and/or external engaging muffs.

As in the header 18, the inlet function and the outlet function of the refrigerant are combined, the header 18 requires at least a two-chamber design which separates an inlet side from the outlet side. For this purpose, a chamber subdivision comprises at least one flat web in form of a longitudinal web, which separates the inlet region in the header 18 communicating with the supply line 14 from an outlet chamber 34 continuously extending longitudinally of the header 18 and communicating with the outlet line 16.

In the evaporator, furthermore the supply of the refrigerant on the side of the inlet to all flat tubes 2 has to be as uniform as possible. In a borderline case, the refrigerant can be supplied to each individual flat tube 2 by a so-called distributor. In most cases, however, the supply is effected to adjacent groups of flat tubes, in which at least some groups comprise a number of flat tubes higher than one, wherein the number of flat tubes per group can also vary. An own inlet chamber is assigned to each group of flat tubes, which chamber directly communicates with the respective group of the flat tubes. The inlet chambers are divided off from one another in the chamber subdivision by crosswise webs designed as flat webs.

In the represented four-flow evaporator, apart from the longitudinal web which divides off the outlet chamber continuous extending longitudinally of the header 18 and following the outlet line 16, another longitudinal web in parallel to this web is provided. This web is intersected at a right angle by the crosswise webs divisioning off the own inlet chambers up to a connection to the longitudinal web. In the elongation of the crosswise webs between the two longitudinal webs, between each of these longitudinal webs an inner deflection (or reversion) chamber contiguous to the respective outer own inlet chamber for deflecting (reversing) the second flow into the third flow is divided off within the header 18.

In case of greater numbers of flows which are guided through the header 18 with a deflection (or reversion) function, the number of the further longitudinal webs as well as the number of the inner deflection chambers increase correspondingly, the deflection chambers then being furthermore internested in the crosswise direction of the header situated internally and one next to the other between the own inlet chambers of the groups of flat tubes 2 as well as the outlet chamber.

The supply line 14 communicates with each of the individual inlet chambers of the groups of flat tubes via an own supply line extending in the header 18, the design of which can vary and which can be combined in one tube, which can be lead out of the narrow front side of the header 18, in this case of the cap 28, together with the bent outer tube connection of the supply line 14 to the block valve 50, which will be later discussed, wherein the distribution of the supplied refrigerant to the own supply lines to the own inlet chambers of the groups of flat tubes 2 can be effected directly behind the block valve 50 and before the beginning of the bent of the supply line 14.

In most cases, in the assembled heat exchanger the block of flat tubes 2 and zig zag fins 8 is laterally terminated by a side sheet metal 46 in contact with each of the outer zig zag fins, such that the side sheet metals 48 form an outer frame for the outer air flowing against the heat exchanger block according to arrow 6 in FIG. 1.

The flat tubes 2, the zig zag fins 8, the tube bottom 26 and the cap 28 of the header together with the optionally provided chamber subdivision as well as the side sheet metals 46 of the heat exchanger consist, as well as conveniently the supply line 14 and the outlet line 16, of aluminum and/or an aluminum alloy and are brazed including the sections of the line connections adjacent to the flat tube heat exchanger to form the finished evaporator, wherein it is possible that the tube bottom 26 and the cap 28 are shaped of solder- or braze-coated sheet metal.

Without the invention being restricted thereto, in practice at least in refrigerant evaporators for motor vehicle air conditioning equipment according to FIG. 1, the supply line 14 and the outlet line 16, which can pass over into the header 18 via corresponding connecting sleeves, are connected to two respective connecting sleeves 48 of a thermostatically controlled block valve 50. At the opposite side, which is not shown, this valve comprises two further connecting sleeves at the side of the inlet and of the outlet.

The individual deflecting bowl 20 comprises a bowl bottom 62 which is essentially flat in the shown embodiments, from which rises a surrounding bowl wall with wall sections 66 at the front side and longitudinal wall sections 68. The flat extension of the bowl bottom 62 is here only to be understood as an example. The longitudinal wall section 68 rises from the bowl bottom 62 essentially at a right angle, such that it overgrips the two flat sides 6 of the respective pertaining flat tube thereby forming a soldering gap. As one can furthermore particularly clearly see in FIG. 3, the wall section 66 on the front side also forms an upright collar 70, which overgrips the narrow front side 4 of the flat tube also forming a soldering gap, wherein a single soldering gap all around the flat tube is formed in the sections on the front side as well as in the longitudinal sections.

Starting from the low end of the upright collar 70, this collar, which is only slightly wider than the flat tube 2, respectively passes over into the flat bowl bottom 62 via a rounded or, according to the drawn representation, straight ramp surface 72, e.g. provided with an inclination angle of about 45°. Here, the two ramp surfaces 72 on the front side are situated opposite the ducts 12 of the flat tube which are the front, e.g. three, and last, e.g. two, ducts, seen in the flow direction of the deflection flow in the deflecting bowl.

Figure 2:
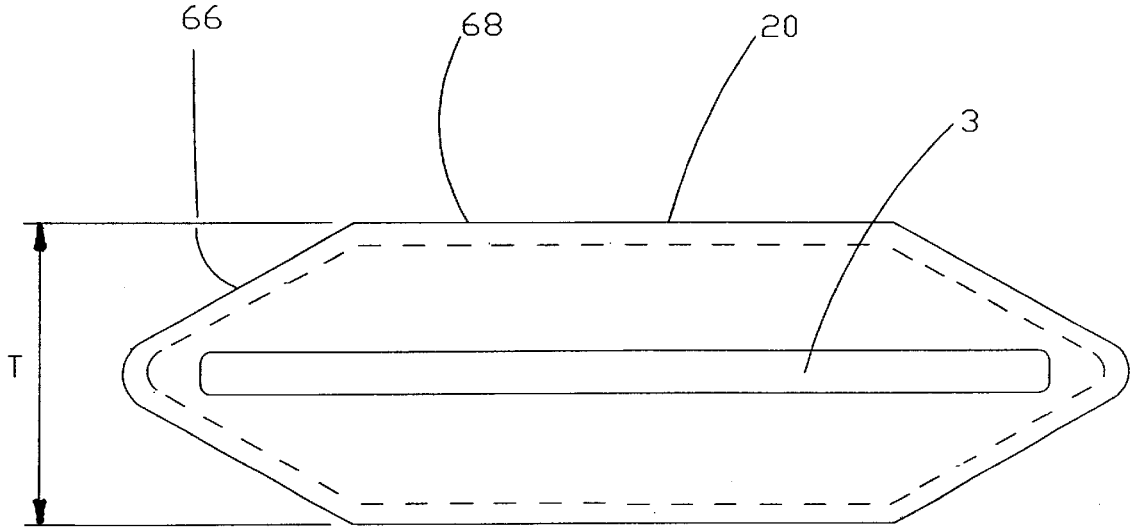
FIG. 2 shows a sheet metal blank before deep-drawing it to form a deflecting (or reversing) bowl.

The deflecting bowl is deep-drawn from a sheet metal of aluminum or an aluminum alloy, which is advantageously coated with braze at the surface forming the later inner face of the deflecting bowl. For each deflecting bowl 20, in this case according to FIG. 2 a sheet metal cut out 20 is punched out of the still flat sheet metal with a pitch (or pitch length) T being greater than the pitch of the arrangement of the flat tubes 2 in the flat tube heat exchanger, and this cut out is deepdrawn using a stamp 3 having the contours of a flat tube 2, the edge sections 66 and 68 of the sheet metal cut out 20 being shaped to form the front and longitudinal wall sections 66 and 68 of the deflecting bowl 20.

In the shown deflecting bowls 20 for the four-flow flat tube heat exchanger, every deflecting bowl forms two deflecting chambers 74 which are each separated from one another by the parting wall 24 in the deflecting bowl. The first deflecting chamber 74, seen in the flow direction of the flows through the respective flat tube 2, deflects (or reverses) the first flow into the second flow, while the other deflecting chamber 74 deflects (or reverses) the third flow into the fourth flow. With a higher number of flows, then at least two parting walls 24 are provided in the deflecting bowl 20 in a manner not shown.

In the embodiments, three types of mounting the parting wall 24 are represented.

Figure 3:
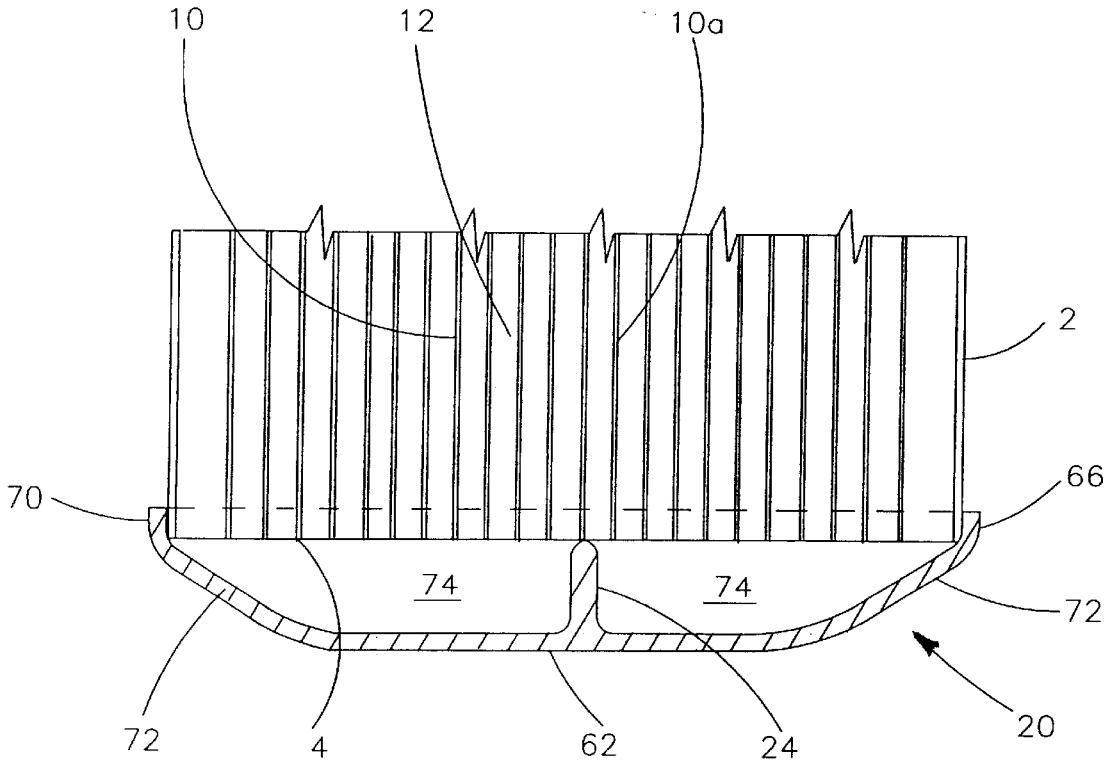
FIG. 3 with FIG. 3*a* show a longitudinal section and a cross-section of the connection region of a deflecting (or reversing) bowl to a flat tube.
Figure 4:
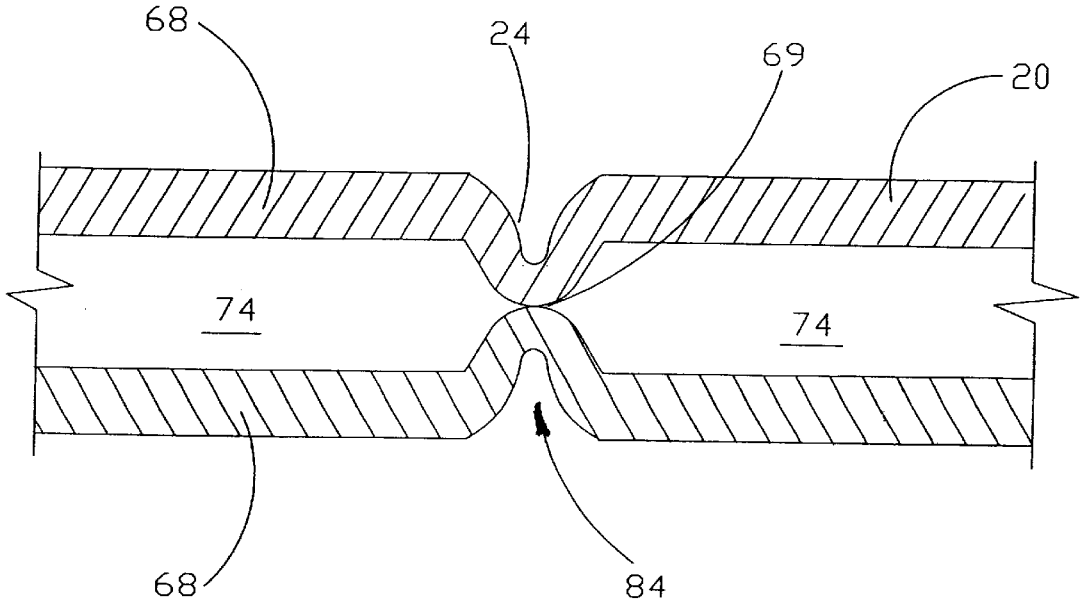
FIG. 4 shows a cross-section through the separating region of the deflecting (or reversing) bowl according to FIG. 3*a*.
Figure 3A:
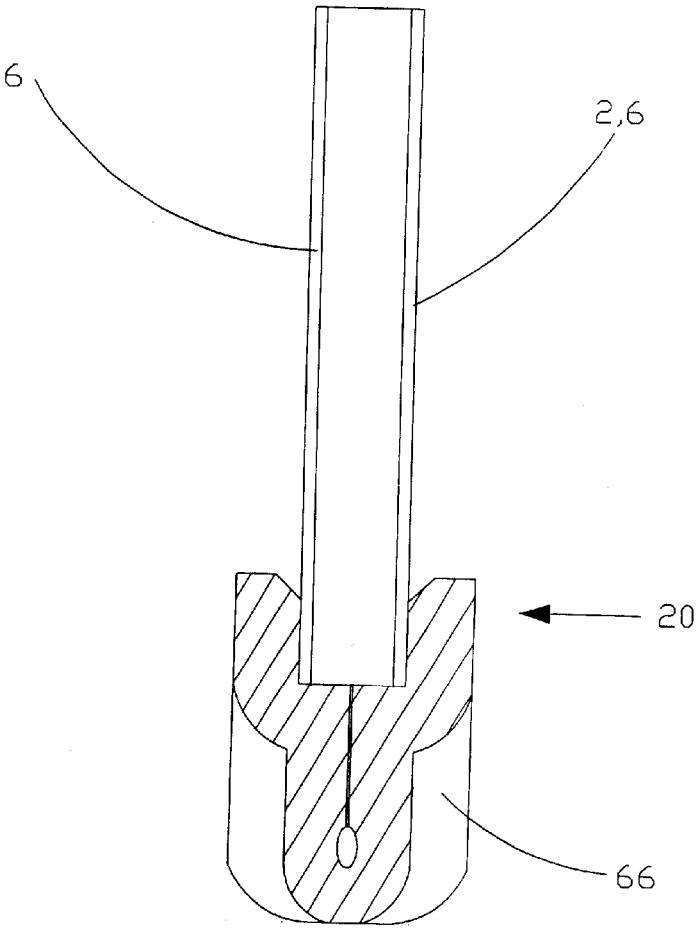
FIG. 3*b* shows a modification of FIG. 3.

FIG. 3 describes the general teaching to design the parting wall 24 as integral part of the deflecting bowl 20 at this bowl itself. FIGS. 3*a* and 4 describe in this case a type of an integral embodiment of the parting wall 24 which in particular is possible in the manufacture of the deflecting bowl from a deep-drawn sheet metal in the sense of FIG. 2. Here, the respective longitudinal wall section 68 is each deformed to form an internal crimp 84 extending at a right angle to the bowl bottom 62 or extending vertically, respectively. The two similar internal crimps 84 are in contact at their apexes 68 for forming the closed parting wall 24 or a corresponding separating web between the chambers 74, respectively.

Various embodiments furthermore embody various types of connecting the respective parting wall 24 of the deflecting bowl 20 to the flat tube 2.

In the embodiment of FIG. 3, the corresponding parting wall 24 at the front side 4 of the flat tube 2 is facing each a single reinforcing web 10*a* of the flat tube 2 in a sealed contact, which separates the second flow from the third flow in the represented four-flow flat tube heat exchanger. Here, the reinforcing web 10*a* can be either offset from the beginning by having refinished the corresponding front side 4 of the flat tube 2 in preparation of the connection before connecting the parting wall 24, or one can take advantage of the parting wall 24 for deforming the reinforcing web 10*a* when joining the parts. Apart from a not shown blunt connection of the parting wall 24 to the reinforcing web 10*a*, in particular according to FIG. 3 a connection via a roundedly profiled front side of the parting wall 24 is possible. It is appreciated that all mentioned types of connection in all embodiments in which a single separating web 10*a* in the flat tube 2 cooperates with a parting wall 24 in the deflecting bowl 20 are interchangeable.

Figure 3B:
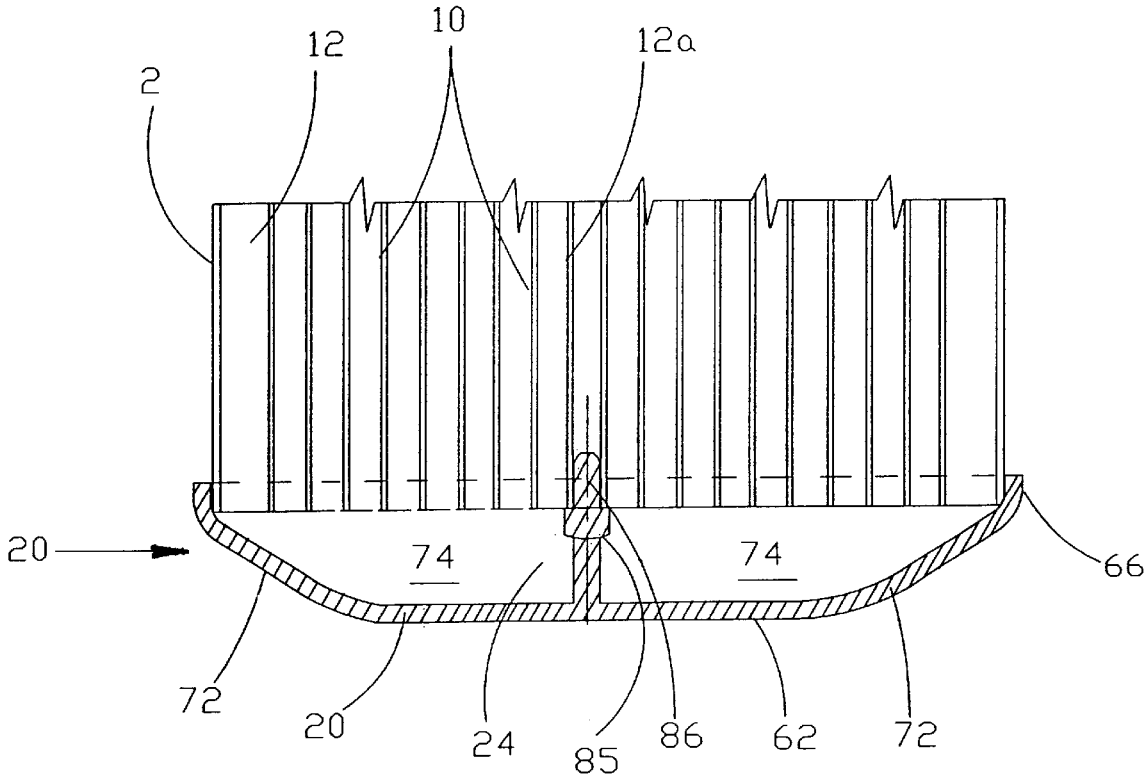

A modification of the connection of the parting wall 24 of a deflecting bowl 20 to the flat tube 2 is shown in FIG. 3*b*. Here, in the connection region of the parting wall, a complete duct 12*a* of the flat tube 2 is cut out, i.e. not used or ineffective as a guiding duct for a flow. The parting wall 24 of the deflecting bowl 20 here tightly cooperates with an insertion member 86, which pin-like engages the cut out duct 12*a* thereby filling out the clear cross-section thereof. Here, the insertion member 86 has a head part 85 directly cooperating with the parting wall 24, which at the back side also overgrips the reinforcing webs 10 boundering on both sides the cut out duct 12*a* and tightly supports itself at the reinforcing webs 10 boundering the cut out duct 12*a* thereby reinforcing the structure of the cut out duct 12*a*.

Figure 5:
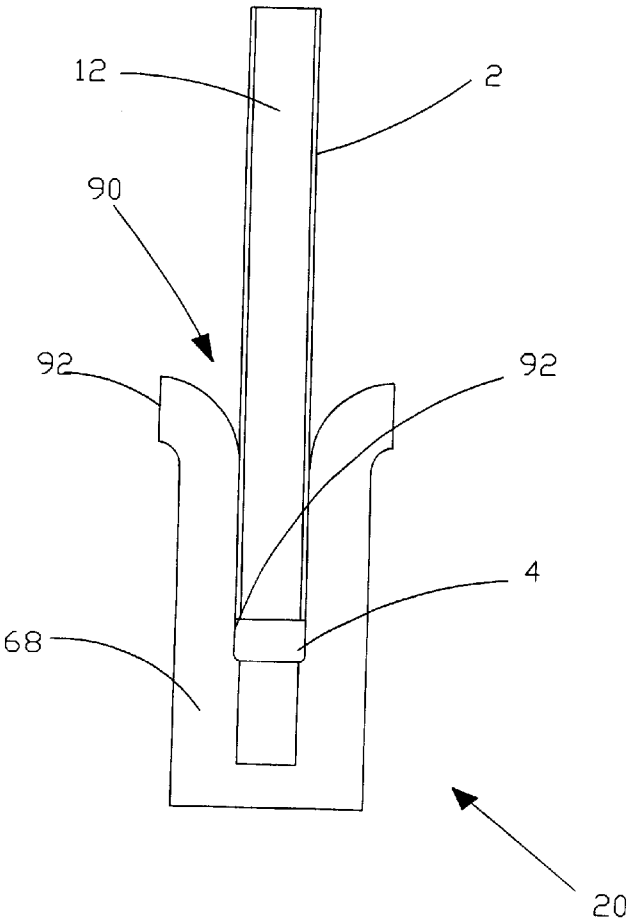
FIG. 5, FIG. 5*a* and FIG. 6 show representations of the kind of connection of the deflecting (or reversing) bowl, wherein FIGS. 5 and 5*a* each show a section in the connection region to a flat side of the flat tube crosswise (FIG. 5) and longitudinal (FIG. 5*a*) of the flat tube
Figure 5A:
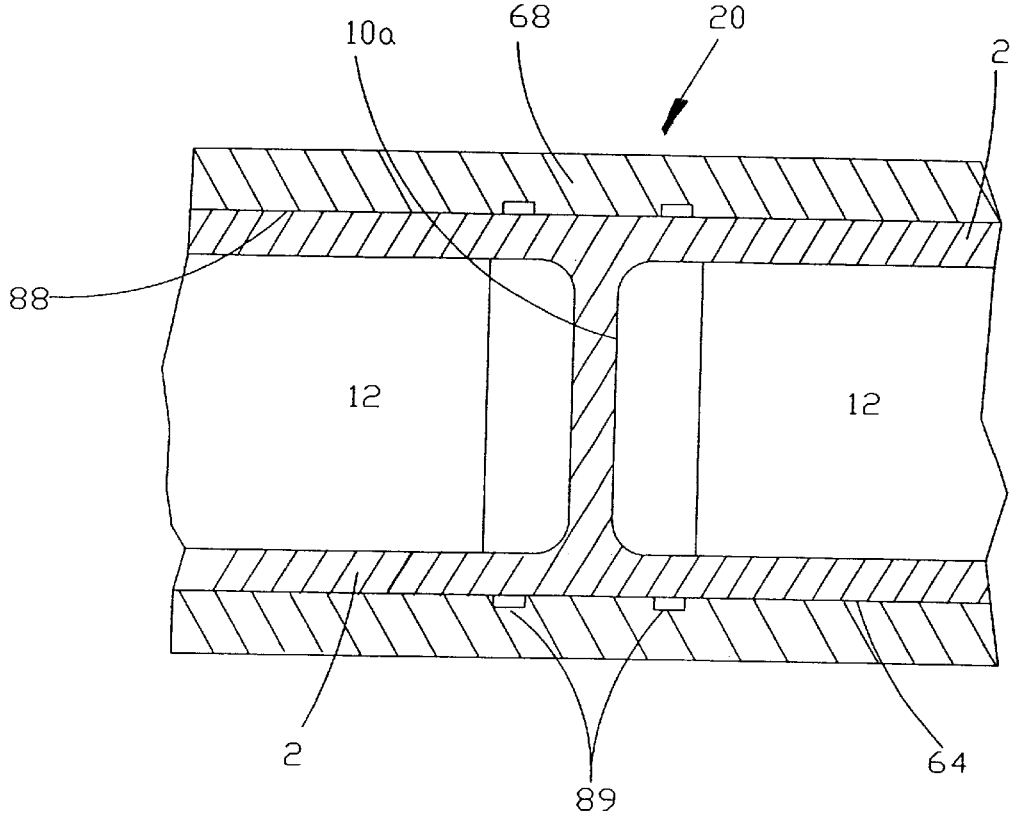
Figure 6:
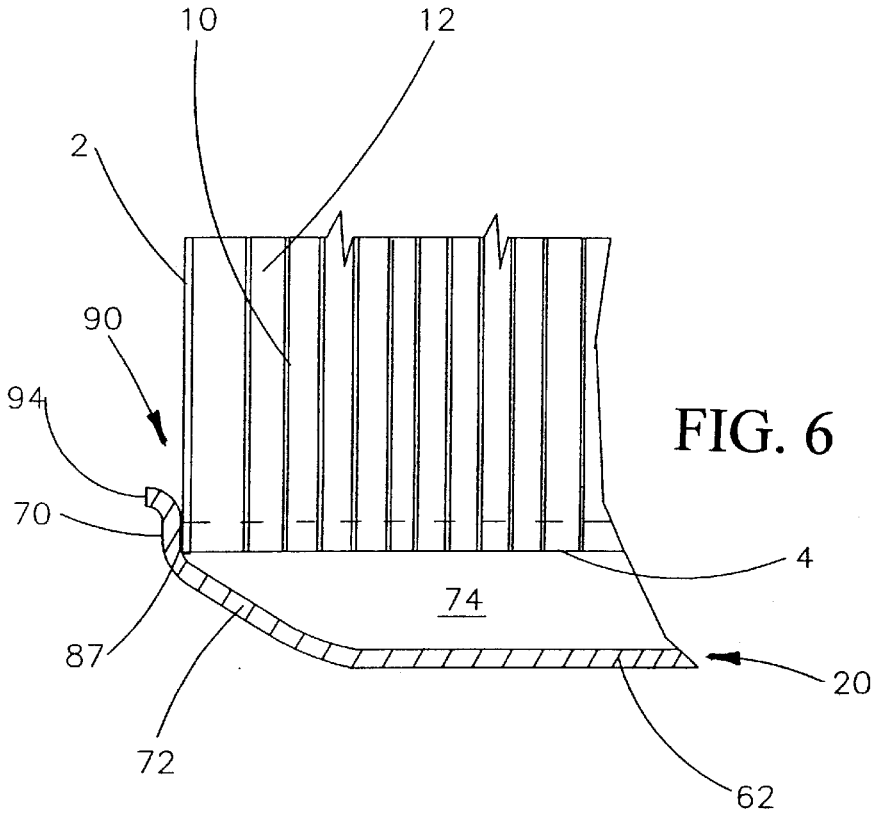

The connection of the deflecting bowl 20 to its related flat tube 2 is finally illustrated with the preferred connection possibilities according to FIGS. 5 to 5*a* and 6.

According to FIG. 6, in the connection region on the front side at the transition from the upright collar 70 to the ramp surface 72, a stop base 87 each for the free ends of the respective flat tube 2 on the front side is designed.

Generally speaking, the respective deflecting bowl 20 including its parting wall 24 acting as separating web is soldered with the flat tube 2 as well as with the whole flat tube heat exchanger by brazing.

Particular difficulties arise when feeding the fluxing agent for the brazing in the region where the parting wall 24 is to be soldered to the flat tube 2. This is illustrated in FIGS. 5 and 5*a* for the particular case that the parting wall 24 not shown in these figures is to be soldered to a single reinforcing web 10*a* of the flat tube. When cutting out a complete duct 12*a* in the sense of FIG. 3*b*, the arrangement would be correspondingly.

According to FIGS. 5 and 5*a*, the deflecting bowl 20 comprises at the internal face 88 of its two longitudinal wall sections 68 locally on both sides of the reinforcing web 10*a*—or in this sense on both sides of a cut out duct 12*a*—each a left open or drawn-in supply flute 89 for supplying fluxing agents for brazing with the separating web of the parting wall 24. Such pairs of feeding flutes 89 are designed in the two longitudinal wall sections 68 of the surrounding bowl wall 64 of the deflecting bowl. At the respective free end of the deflecting bowl 20, they run into a funnel-like outer opening in the form of a tulip 90 of this edge provided at that location and extend according to FIG. 5 somewhat beyond the free end 4 of the flat tube in order to hold open at that location a free supply cross-section 92 of the supply of the fluxing agent to the edge regions of the parting wall 24.

According to FIGS. 5 and 6, generally the surrounding free edge of the deflecting bowl is bent to the outside thereby forming the opening 90 in the form of a tulip receiving the free end of the flat tube in such a way that the free front side 94 of this free edge extends in the extension direction of the flat tubes 2.

What is claimed is:

1. A flat tube heat exchanger comprising:

a plurality of flat tubes, each said tube having a top end and a bottom end, each said tube divided into a plurality of fluid ducts by a plurality of separating webs, each said tube configured to provide more than two flows;

a deflecting bottom disposed near the bottom end of said tubes and including a plurality of deflecting bowls individually assigned to each said tube and deep-drawn from aluminum or an aluminum alloy, the bowls being connected to one another only via their connection to said respectively assigned flat tubes; and a parting wall arranged to sealingly cooperate with the end of a selected separating web formed by a cut out duct of said flat tube which is not used as a guiding duct for a flow and is between adjacent ducts of flows communicating not directly in the bottom end, the parting wall being a local wall design of the deflecting bowl.

2. A flat tube heat exchanger according to claim 1, wherein the local wall design cooperates only with the selected parting wall of adjacent ducts of said respective flat tube.

3. A flat tube heat exchanger according to claim 1, wherein the parting wall sealingly engages the insertion member.

4. A flat tube heat exchanger according to claim 1, wherein the parting wall is formed by locally squeezing longitudinal wall sections of the deflecting bowl from both sides.

5. A flat tube heat exchanger according to claim 1, wherein the deflecting bowl further comprises a pair of stop bases adapted to engage a front and a rear face of said respective flat tube.

6. A flat tube heat exchanger according to claim 1, wherein the deflecting bowl has an inner face toward said tubes including a supply flute near the parting wall adapted to permit the supply of a fluxing agent for a braze to the parting wall.

7. A flat tube heat exchanger according to claim 1, wherein a surrounding free edge of the deflecting bowl is bent to the outside forming an opening in the form of a tulip for receiving the bottom end of said flat tube and extends with a front side into the extension direction of said flat tubes.

8. A process for manufacturing a flat tube heat exchanger comprising:

providing a plurality of flat tubes and a plurality of separate deflecting bowls;

forming a parting wall by locally squeezing longitudinal wall sections of the deflecting bowl;

mechanically pre-assembling a plurality of structural parts from said deflecting bowls with said flat tubes;

mechanically pre-assembling the flat tube heat exchanger from said structural parts; and fastening together the flat tube heat exchanger.

9. The process of claim 8, wherein providing the plurality of deflecting bowls comprises:

providing a plurality of sheet metal blanks; and deep-drawing said sheet metal blanks into said deflecting bowls, each of said bowls having a longitudinal section and a bowl bottom section.

10. The process of claim 9, wherein said deflecting bowls are drawn from a material selected from the group consisting of aluminum and an aluminum alloy.

11. The process of claim 8, wherein said fastening comprises soldering together the flat tube heat exchanger.

12. The process of claim 8, wherein said fastening comprises brazing together the flat tube heat exchanger.

13. The process of claim 8, wherein the mechanical pre-assembly of the plurality of structural parts comprises:

providing a one of the flat tubes having a pair of flat sides;

providing a one of the separate deflecting bowls having a bowl bottom section and a longitudinal section rising substantially at right angles to the bowl bottom section; and overgripping the pair of flat sides of the one of the flat tubes with the longitudinal section of the one of the separate deflecting bowls to form a one of the structural parts.

14. A flat tube heat exchanger comprising:

a plurality of flat tubes, each said tube having an upper and a lower end, each said tube including a plurality of reinforcing webs forming at least three longitudinal flow paths;

each said tube further comprises an insertion member inset into a cut out longitudinal flow path that is not otherwise used as a longitudinal flow path; and a plurality of separately formed deflecting bowls adapted to sealingly engage the lower end of each said tube, each said deflecting bowl including an intergally formed parting wall extending longitudinally upwardly and preventing fluid communication between at least one pair of adjacent, cross-current longitudinal flow paths, wherein the parting wall sealingly engages the insertion member.

15. A motor vehicle comprising an evaporator including the flat tube heat exchanger of claim 14.

* * * * *

UNITED STATES PATENT AND TRADEMARK OFFICE

CERTIFICATE OF CORRECTION

PATENT NO. : 6,315,037 B1
DATED : November 13, 2001
INVENTOR(S) : Roland Haussmann It is certified that error appears in the above-identified patent and that said Letters Patent is hereby corrected as shown below:

Title page,
Item [86], the §371 Date should read -- January 5, 1999 --

Signed and Sealed this

Twenty-third Day of April, 2002

*Attest:*

*Attesting Officer*

JAMES E. ROGAN
*Director of the United States Patent and Trademark Office*